US011261020B2

(12) United States Patent
Miura

(10) Patent No.: US 11,261,020 B2
(45) Date of Patent: Mar. 1, 2022

(54) CONTAINER FOR HOUSING HOUSEHOLD TISSUE PAPER

(71) Applicant: DAIO PAPER CORPORATION, Shikokuchuo (JP)

(72) Inventor: Akiteru Miura, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 0 days.

(21) Appl. No.: 16/970,100

(22) PCT Filed: Feb. 22, 2019

(86) PCT No.: PCT/JP2019/006685
§ 371 (c)(1),
(2) Date: Aug. 14, 2020

(87) PCT Pub. No.: WO2019/171976
PCT Pub. Date: Sep. 12, 2019

(65) Prior Publication Data

US 2021/0024278 A1 Jan. 28, 2021

(30) Foreign Application Priority Data

Mar. 5, 2018 (JP) ..... JP2018-038896

(51) Int. Cl.
*A47K 10/20* (2006.01)
*B65D 83/08* (2006.01)
(Continued)

(52) U.S. Cl.
CPC ..... *B65D 83/0805* (2013.01); *A47K 10/20* (2013.01); *A47K 10/421* (2013.01);
(Continued)

(58) Field of Classification Search
CPC ... B65D 83/0805; A47K 10/20; A47K 10/421
(Continued)

(56) References Cited

U.S. PATENT DOCUMENTS 5,699,912 A 12/1997 Ishikawa et al.
6,206,221 B1 3/2001 Bando et al.
(Continued)

FOREIGN PATENT DOCUMENTS

JP H11079214 A 3/1999
JP 2000211680 A 8/2000
(Continued)

OTHER PUBLICATIONS

Related U.S. Appl. No. 16/970,079; First Named Inventor: Akiteru Miura; Title: Container for Housing Household Tissue Paper.
(Continued)

*Primary Examiner* — Gene O Crawford
*Assistant Examiner* — Ayodeji T Ojofeitimi
(74) *Attorney, Agent, or Firm* — Maier & Maier, PLLC

(57) ABSTRACT

A container for housing household tissue paper includes a container body that stores household tissue paper inside. The container body has an upper container body that forms an upper portion of the container body and a lower container body that forms a lower portion of the container body. The upper container body has an outlet through which the household tissue paper is taken out and an open/close lid that seals the outlet. A lower end of the upper container body and an upper end of the lower container body are connected to each other, and the upper container body and the lower container body are pivotable with respect to each other.

8 Claims, 6 Drawing Sheets

(51) Int. Cl.
*A47K 10/42* (2006.01)
*A47K 10/32* (2006.01)

(52) U.S. Cl.
CPC ..... *A47K 2010/3233* (2013.01); *A47K 2010/3266* (2013.01); *B65H 2402/41* (2013.01); *B65H 2701/1924* (2013.01)

(58) Field of Classification Search
USPC ..... 221/33–63
See application file for complete search history.

(56) References Cited

U.S. PATENT DOCUMENTS

| | | | | |
|---|---|---|---|---|
| 10,123,667 | B2 | 11/2018 | Miura | |
| 2005/0279756 | A1* | 12/2005 | Bitowft | A47K 10/426 221/45 |
| 2008/0011767 | A1* | 1/2008 | Beavers Blanks | B65D 1/26 221/64 |
| 2015/0272406 | A1* | 10/2015 | Hill | A47K 10/421 221/48 |
| 2017/0303749 | A1 | 10/2017 | Miura | |

FOREIGN PATENT DOCUMENTS

| | | | |
|---|---|---|---|
| JP | 2003095301 | A | 4/2003 |
| JP | 3962410 | B2 | 5/2007 |
| JP | 2008207833 | A | 9/2008 |
| JP | 2010001046 | A | 1/2010 |
| JP | 2010076822 | A | 4/2010 |
| JP | 2010228766 | A | 10/2010 |
| JP | 2012025484 | A | 2/2012 |
| JP | 2013227067 | A | 11/2013 |
| JP | 2016069028 | A | 5/2016 |
| JP | 2016172581 | A | 9/2016 |
| JP | 2016175684 | A | 10/2016 |
| WO | 2016185844 | A1 | 11/2016 |

OTHER PUBLICATIONS

International Preliminary Report on Patentability (IPRP) (and English language translation thereof) dated Sep. 8, 2020 issued in International Application No. PCT/JP2019/006685.

International Search Report (ISR) (and English translation thereof) dated Apr. 9, 2019 issued in International Application No. PCT/JP2019/006685.

Japanese Office Action (and English language translation thereof) dated Nov. 13, 2018 issued in Japanese Application No. 2018-038896.

Written Opinion dated Apr. 9, 2019 issued in International Application No. PCT/JP2019/006685.

Extended European Search Report dated Sep. 27, 2021, in connection with corresponding EP Application Mo 19763703.6; 9 pages.

Office Action dated Dec. 3, 2021, in connection with corresponding Chinese Application No. 201980012325.2 (18 pp., including machine-generated English translation).

* cited by examiner

CONTAINER FOR HOUSING HOUSEHOLD TISSUE PAPER

TECHNICAL FIELD

The present invention relates to a container for housing household tissue paper.

BACKGROUND ART

It is essential to be able to refill the household thin paper inside a container for household tissue paper such as wet tissues. As a mechanism for refilling, a container body is known to have a removable bottom lid (for example, Japanese Patent Application Publication No. 2016-172581).

SUMMARY OF INVENTION

In such a container for housing household tissue paper, it takes a lot of time and effort to refill household tissue paper inside the container because it is necessary to lift the container, turn over the container, remove the bottom lid, fill the household tissue paper inside, attach the lid, and turn over the container again.

An object of the present invention is to provide a container for housing household tissue paper that makes it easy to refill household tissue paper in the container.

One aspect of the invention is a container for housing household tissue paper, which includes a container body that stores household tissue paper inside. The container body has an upper container body that forms an upper portion of the container body and a lower container body that forms a lower portion of the container body. The upper container body has an outlet through which the household tissue paper is taken out, and an open/close lid that seals the outlet. A lower end of the upper container body and an upper end of the lower container body are connected to each other, and the upper container body and the lower container body are pivotable with respect to each other. With this structure, it is easy to refill the inside household tissue paper.

In the container for housing household tissue paper, the container body may be formed in a substantially rectangular parallelepiped shape, and the upper container body and the lower container body may be connected to each other only at one side of the container body. With this structure, it is easy to refill the inside household tissue paper. In the container for housing household tissue paper, the container body may be divided into the upper container body and the lower container body above a middle position of the container body in an upper-lower direction. With this structure, it is easier to refill the inside household tissue paper.

In the container for housing household tissue paper, the upper container body may have an upper fitting portion formed of an elastic material at the lower end of the upper container body, the upper fitting portion being formed around the upper container body except for a portion of the upper container body connected to the lower container body, and the lower container body may have a lower fitting portion formed of an elastic material at the upper end of the lower container body, the lower fitting portion fitting to the upper fitting portion and being formed around the lower container body except for a portion of the lower container body connected to the upper container body. With this structure, it is possible to improve a sealing property of the container body.

In the container for housing household tissue paper, the upper fitting portion may have an upper protrusion that protrudes in a lower direction only at an outer circumferential side or an inner circumferential side of the upper fitting portion, and the lower fitting portion may have a lower protrusion that protrudes in an upper direction only at an inner circumferential side or an outer circumferential side of the lower fitting portion, the upper protrusion and the lower protrusion being configured to fit to each other. With this structure, it is possible to further improve the sealing property of the container body.

In the container for housing household tissue paper, the upper fitting portion may have upper projections and upper recessed portions that are formed alternately in a peripheral direction of the upper fitting portion, and the lower fitting portion may have lower projections and lower recessed portions that are formed alternately in a peripheral direction of the lower fitting portion, wherein when the upper fitting portion and the lower fitting portion fit to each other, the upper recessed portions and the lower projections fit to each other and the upper projections and the lower recessed portions fit to each other. With this structure, it is possible to firmly fit the upper container body and the lower container body.

In the container for housing household tissue paper, the lower container body may have a nonslip portion formed of an elastic material at a lower surface of the lower container body. With this structure, the container is less likely to slip when household tissue paper is used.

In the container for housing household tissue paper, the hardness of the elastic material is preferably 20 or more and 90 or less, measured in accordance with JIS K 6253 (type A durometer). With this structure, it is possible to further improve the sealing property of the container body.

According to the present invention, there is provided a container for housing household tissue paper that makes it easy to refill household tissue paper in the container.

DETAILED DESCRIPTION

Hereinafter, the container for housing household tissue paper 100 as an embodiment of the present invention is described in detail with reference to FIG. 1 to FIG. 6. However, the scope of the invention is not limited to the illustrated examples.

Figure 1:
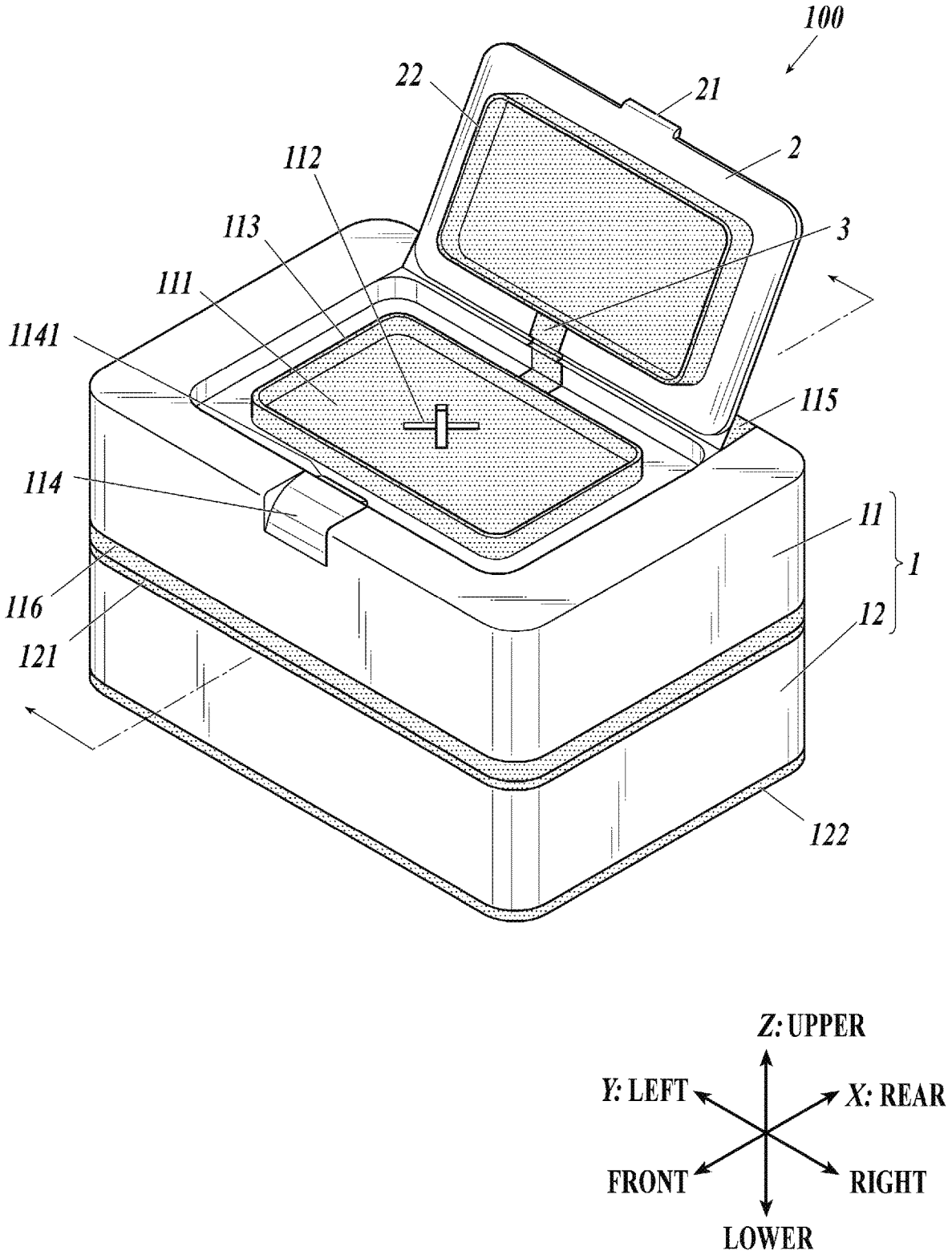
FIG. 1 is a perspective view of a container for housing household tissue paper according to an embodiment. Shaded areas represent portions formed of an elastic material.

In the following description, an X-axis, Y-axis, Z-axis, front-rear direction, left-right direction, and upper-lower direction are defined as shown in FIG. 1. That is, the side of the container for housing household tissue paper 100 on which the open/close lid 2 is provided and the side opposite thereto are referred to as "upper" and "lower", respectively. The side where a container body 1 and the open/close lid 2 are connected and the side opposite thereto are referred to as "rear" and "front", respectively. The right-hand side and the left-hand side when one is facing toward the rear are referred to as "right" and "left", respectively. The axis along the front-rear direction is referred to as the X axis, the axis along the left-right direction is referred to as the Y axis, and the axis along the upper-lower direction is referred to as the Z axis.

[Configuration of Embodiment]

{Overall Configuration}

As shown in FIG. 1, the container for housing household tissue paper 100 includes a container body 1 that has an outlet 112 through which the inside tissue paper is taken out, an open/close lid 2 that is connected to the container body 1 and freely opened and closed so as to cover the outlet 112, and a biasing means 3 that extends from container body 1 to the open/close lid 2 and biases the open/close lid 2 in an opening direction. The container body 1 has a housing space S to store the household tissue paper inside.

The container body 1 and the open/close lid 2 can be integrally formed by injection molding (double molding).

{Household Tissue Paper}

The household tissue paper P is, for example, so-called pop-up type sheets in which small wet sheets, wet tissues, or the like are folded and stacked in alternating directions such that, as one wet sheet, wet tissue, or the like is pulled out, the next one is also pulled out. Another example of the household tissue paper P is a roll sheet that is a long wet sheet, wet tissue, or the like that is wound into a roll and has perforations at regular intervals in the length direction so as to be cut along the perforations and used.

{Container Body}

As shown in FIG. 1, the container body 1 as a whole is formed in a substantially rectangular parallelepiped shape that is longer in the Y direction than in the X and Z directions. The container body 1 is vertically divided into two parts almost in the middle in the Z direction, one being an upper container body 11 constituting the upper side of the container body 1 and the other being a lower container body 12 constituting the lower side of the container body 1. The upper container body 11 and the lower container body 12 are connected to each other on the rear side of the container body 1.

The container body 1 and the open/close lid 2 can be integrally formed by injection molding (double molding).

The dimensions of the container body 1 as a whole are preferably 60 mm to 150 mm, more preferably 80 mm to 100 mm in the X direction, preferably 80 mm to 200 mm, more preferably 145 mm to 165 mm in the Y direction, and preferably 30 mm to 100 mm, more preferably 50 mm to 70 mm in the Z direction. The thickness of each surface is preferably 0.5 mm to 3 mm, more preferably 1 mm to 2 mm.

With such dimensions and thickness, it is possible to achieve high molding efficiency and strength that does not cause any problems in actual use.

Figure 4:
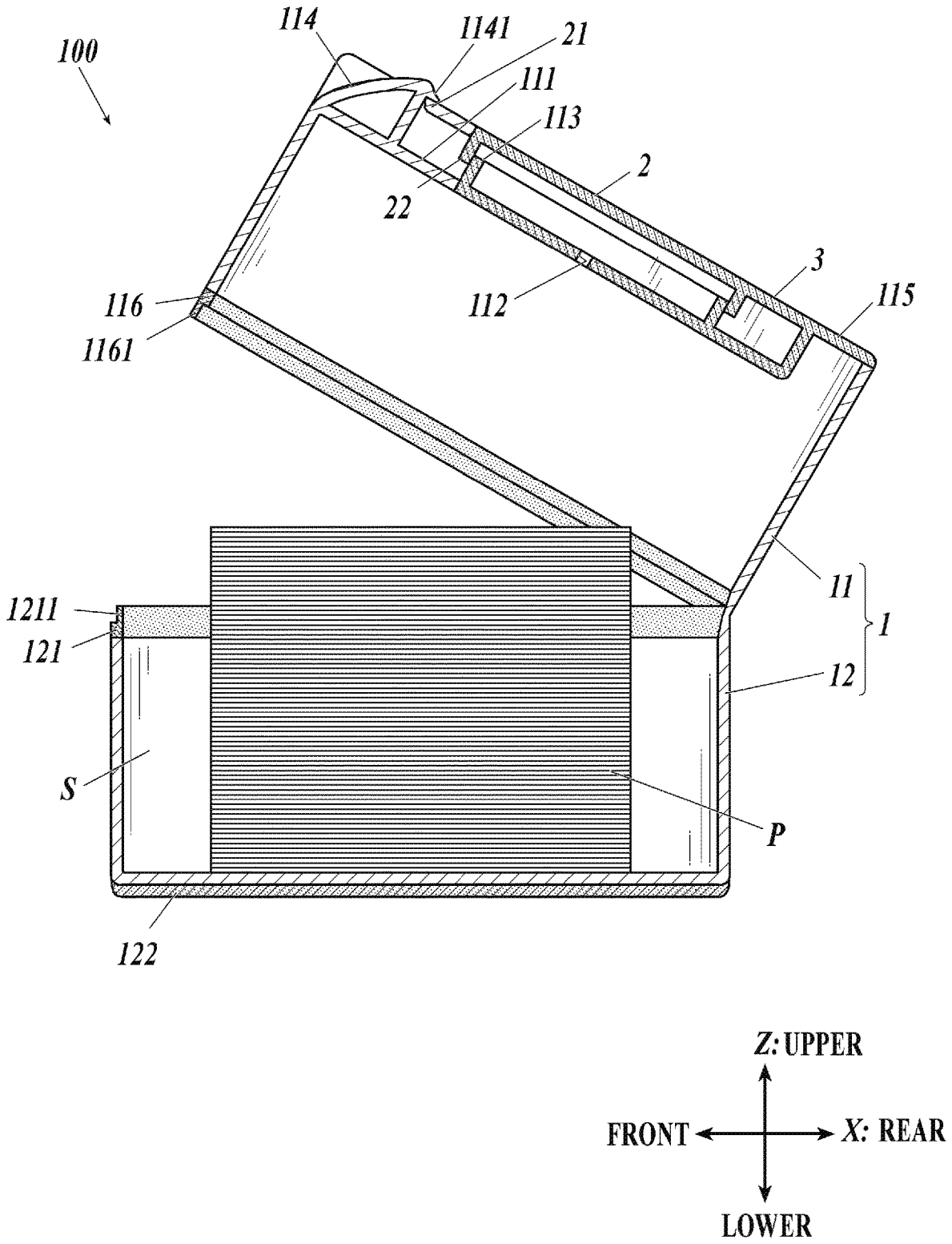
FIG. 4 is a sectional view of the same portion as FIG. 2 when an upper container body and a lower container body are out of a state fitting to each other. Shaded areas represent portions formed of an elastic material.

As shown in FIG. 4, the container body 1 can expose the internal housing space S to the outside in response to pivoting of the upper container body 11 upward around a pivot point on the rear side of the container body 1. The upper container body 11 and the lower container body 12 are connected at the pivot point.

Figure 2:
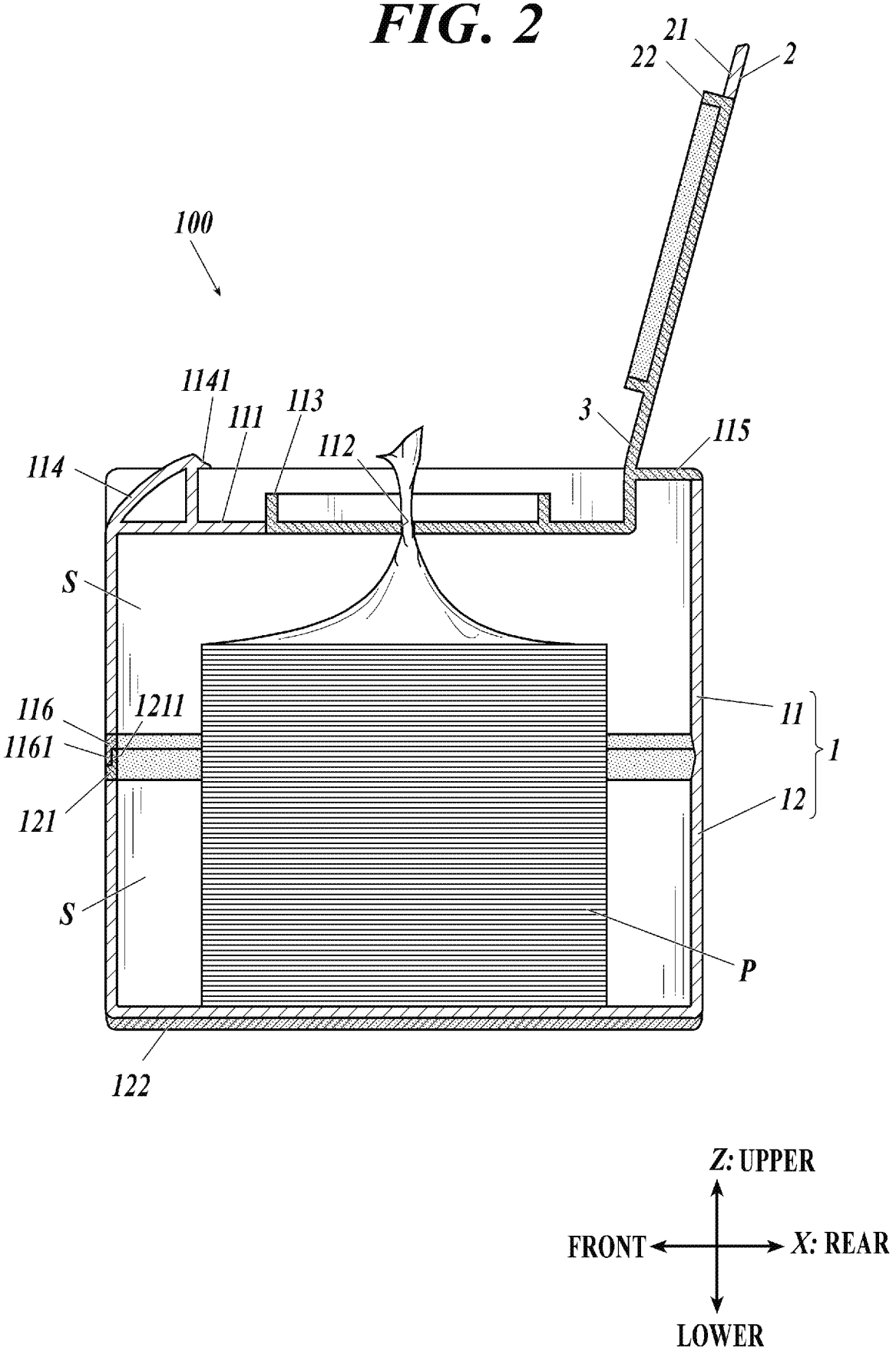
FIG. 2 is a sectional view of FIG. 1 cut through a middle portion in Y direction. Shaded areas represent portions formed of an elastic material.
Figure 3:
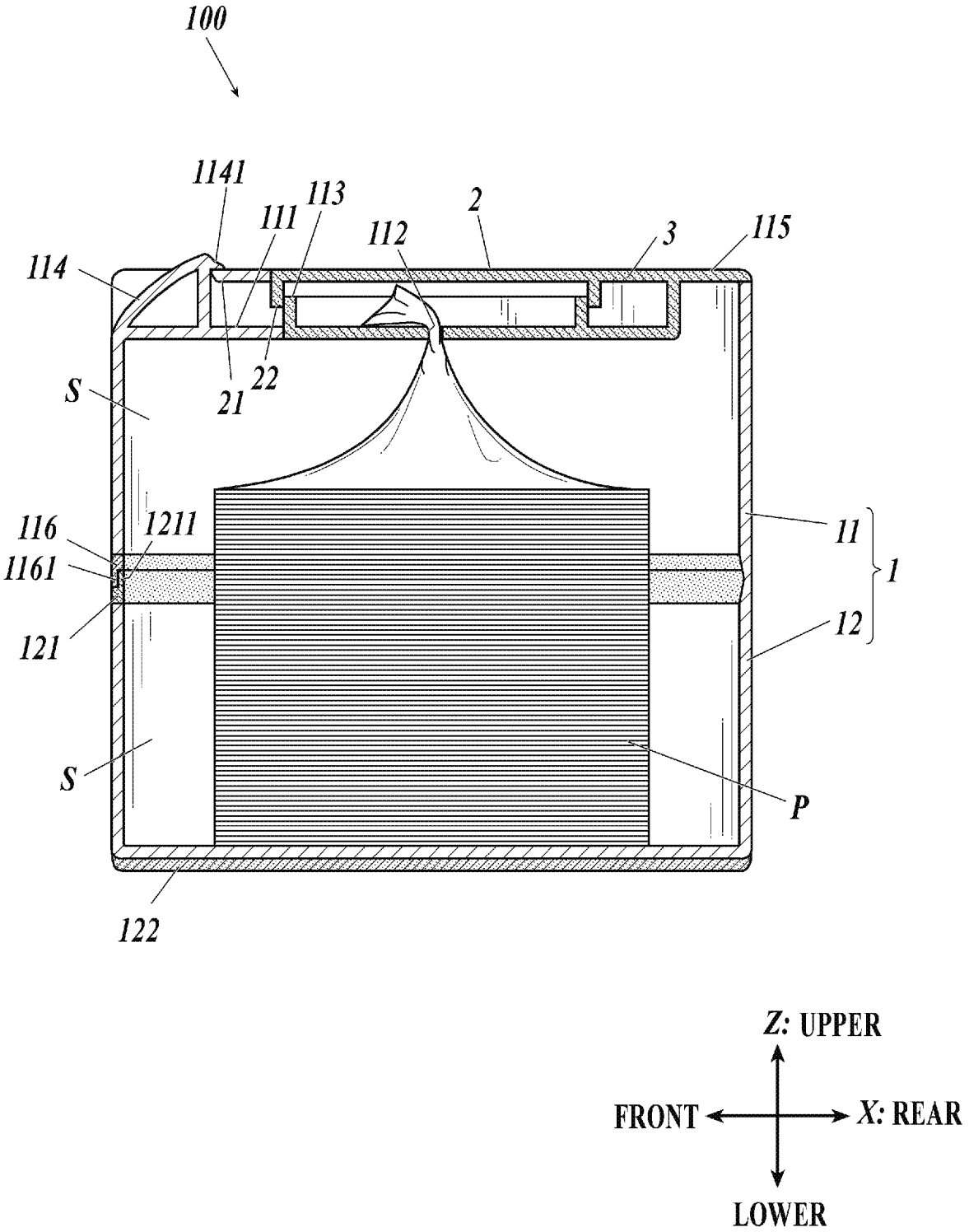
FIG. 3 is a sectional view of the same portion as FIG. 2 when an open/close lid is in a closing state. Shaded areas represent portions formed of an elastic material.

As shown in FIG. 2 to FIG. 4, a connecting portion between the upper container body 11 and the lower container body 12 on the rear side of the container body 1 is formed so as to be thinner than other portions of the container body 1. Therefore, the rear surface of the container body can be readily bent at the connecting portion. This makes it easy to pivot the upper container body 11 with respect to the lower container body 12 around the connecting portion as a pivot point.

Alternatively, though productivity is reduced, the upper container body 11 and the lower container body 12 can be formed separately and connected pivotably by using a hinge or the like.

The container body 1 is divided into the upper container body 11 and the lower container body 12 almost in the middle in the Z direction in the drawings, but is more preferably divided at above the middle position in the Z direction. This reduces the possibility that an end seal portion(s) of the package is pinched when the container is closed, and thereby makes it easier to refill the household tissue paper P to be stored in the container body 1 while being covered with a predetermined package.

(Upper Container Body)

As shown in FIG. 1 to FIG. 4, the upper container body 11 is formed in a substantially rectangular parallelepiped shape having an opening lower surface and has a recessed portion 111 having a sunken recessed shape on the upper side of the upper container body 11. An outlet 112 for taking out the household tissue paper P in the housing space S is provided in the middle of the recessed portion 111 and is surrounded by a body-side sealing loop 113.

Furthermore, a latch 114 for opening and closing the open/close lid 2 is formed at the front portion of the upper surface, and an upper nonslip portion 115 is formed at the rear portion of the upper surface to stable the open/close lid 2 when it is opened.

Around the opening lower surface is formed an upper fitting portion 116 that fits to a lower fitting portion 121 of the lower container body 12 described later.

(Outlet)

The outlet 112 is a hole that is formed almost in the middle of the upper surface of the upper container body and connects to the housing space S.

The outlet 112 is formed by making two intersecting cuts in FIG. 1, but the present invention is not limited to this, and the number of cuts may be more than two. For example, three cuts connecting respective vertices of a right triangle and the center of gravity of the right triangle may be made.

The periphery of the outlet 112 is formed of a material having elasticity described later so as to apply appropriate resistance to the household tissue paper P. As a result, when a sheet of the household tissue paper P in the housing space S is pulled out, the next sheet of the household tissue paper P is held by the outlet 112. Furthermore, when the household tissue paper P is a roll sheet, outlet 112 can cut the household tissue paper P at its perforations provided for cutting.

(Body-Side Sealing Loop)

As shown in FIG. 1, the body-side sealing loop 113 is a loop-shaped projection protruding in the upper direction and surrounding the outlet 112. As shown in FIG. 3 and FIG. 4, the outer periphery of the body-side sealing loop 113 is formed so as to fit to the inner periphery of the open/close-lid-side sealing loop 22 formed on the open/close lid 2 as described later.

(Latch)

As shown in FIG. 1, the latch 114 is formed of a button shape having a body-side hook 1141. The body-side hook 1141 engages with the open/close-lid-side hook 21 formed on the open/close lid 2 described later to latch the open/close lid 2 in a closing state. When a user pushes the latch 114, the body-side hook 1141 and the open/close-lid-side hook 21 are disengaged, and the open/close lid 2 is opened.

(Upper Nonslip Portion)

As shown in FIG. 1, the open/close lid 2 in an open state is less likely to slip because of the upper nonslip portion 115 that is formed on the upper surface of the upper container body 11 at the rear side of the connecting portion between the upper container body 11 and the open/close lid 2. The frictional resistance of the upper nonslip portion 115 with the lid is high because it is formed of an elastic member as described later and thereby the lid is prevented from swinging.

(Upper Fitting Portion)

As shown in FIG. 1 to FIG. 4, the upper fitting portion 116 is formed around the opening lower surface of the upper container body 11 except for the rear side of the opening where the upper container body 11 and the lower container body 12 are connected to each other. As shown in FIG. 2 to FIG. 4, only the outer periphery of the lower edge of the upper fitting portion 116 protrudes to form an upper protrusion 1161. The inner periphery of the upper protrusion 1161 is formed so as to fit to the outer periphery of the lower protrusion 1211 of the lower fitting portion 121 formed in the lower container body 12 as described later.

The upper fitting portion 116 is formed such that the upper protrusion 1161 has a dimension in the upper-lower direction of preferably 0.5 mm to 5 mm, more preferably 1 mm to 3 mm.

(Material of Upper Container Body)

As shown in FIG. 1, the upper container body has the body-side sealing loop 113 on the upper surface and a portion surrounded by the body-side sealing loop 113 in the recessed portion 111 that are formed of a material having elasticity (hereinafter, referred to as an "elastic material") such as silicone rubber and thermoplastic elastomer such as styrene-butadiene type, polyester type, polyethylene type, and urethane type. The hardness of the elastic material is preferably 20 to 90. The hardness is measured in accordance with JIS K 6253 (type A durometer).

In the upper container body 11, a portion forming a biasing member 3 described later, the upper nonslip portion 115, and the upper fitting portion 116 are also formed of a similar elastic material.

The other portions in the upper container body are formed of, for example, polyethylene, polypropylene, and the like.

They are integrally formed by injection molding (double molding).

When the hardness is less than the above, the elastic material is too soft and difficult to be molded, which results in poor molding efficiency. Furthermore, such a biasing member 3 cannot bias the open/close lid 2 enough in an opening direction. When the hardness is more than the above, the hard portion around the outlet 112 increases the resistance too much and makes it difficult to take out the sheet one by one and to put fingers inside the container for pulling out the sheet. Furthermore, such a biasing member 3 biases the open/close lid 2 too much in the opening direction.

Therefore, the hardness of the elastic material is preferably within the above range.

(Lower Container Body)

As shown in FIG. 1 to FIG. 4, the lower container body 12 is formed in a substantially rectangular parallelepiped shape having an opening upper surface. Around the opening upper surface is formed a lower fitting portion 121 that fits to the upper fitting portion 116 of the upper container body 11. A lower nonslip portion 122 is formed on the lower surface.

(Lower Fitting Portion)

As shown in FIG. 1 to FIG. 4, the lower fitting portion 121 is formed around the upper opening of the lower container body 12 except for the rear side of the opening where the lower container body 12 and the upper container body 11 are connected to each other. As shown in FIG. 2 to FIG. 4, only the inner peripheral portion of the upper edge of the lower fitting portion 121 protrudes to form a lower protrusion 1211. The outer periphery of the lower protrusion 1211 is formed so as to fit to the inner periphery of the upper protrusion 1161 of the upper fitting portion 116 formed in the upper container body 11.

The lower fitting portion 121 is formed such that the lower protrusion 1211 has a size in the upper-lower direction of preferably 0.5 mm to 5 mm, more preferably 1 mm to 3 mm.

Alternatively, only the inner peripheral side of the upper protrusion 1161 of the upper fitting portion 116 and only the outer peripheral side of the lower protrusion 1211 of the lower fitting portion 121 may be each formed to protrude, such that the outer periphery of the upper protrusion 1161 fits to the inner periphery of the lower protrusion 1211.

Alternatively, the middle portion between the inner and outer peripheral sides of the upper protrusion and both of the inner and outer peripheral sides of the lower protrusion may be each formed to protrude, such that the upper protrusion fits to a recessed portion between the lower protrusions. Conversely, both of the inner and outer peripheral sides of the upper protrusion and the middle portion between the inner and outer peripheral sides of the lower protrusion may be each formed to protrude, such that the lower protrusion fits to a recessed portion between the upper protrusions.

(Lower Nonslip Portion)

The placed container for housing household tissue paper 100 is less likely to slip because of a lower nonslip portion 122 that is formed by providing a portion made of an elastic material on the lower surface of the lower container body 12 integrally with other portions.

(Material of Lower Container Body)

The lower container body 12 has the lower fitting portion 121 and the lower nonslip portion 122 that are formed of a similar elastic material as used in the upper container body 11, and the other portions are formed of, for example, polyethylene, polypropylene, and the like.

They are integrally formed by injection molding (double molding).

{Open/Close Lid}

As shown in FIG. 1 to FIG. 4, the open/close lid 2 is a flat, a substantially rectangular member that is pivotably connected to the rear side of the recessed portion 111 of the upper container body 11, and has an open/close-lid-side hook 21 on the front side and an open/close-lid-side sealing loop 22 on the lower surface side.

As shown in FIG. 1 to FIG. 4, the shape of the open/close lid 2 in a plan view in the closing state is formed to be substantially the same as that of the recessed portion 111 of the upper container body 11, so that the open/close lid 2 can fit to the recessed portion 111 when closed.

(Open/Close-Lid-Side Hook)

As shown in FIG. 1 to FIG. 4, the open/close-lid-side hook 21 is a hook protruding from the open/close lid 2 toward the front. The open/close-lid-side hook 21 engages with the body-side hook 1141 formed on the latch 114 of the upper container body 11 and latches the open/close lid in the closing state. When a user pushes the latch 114, the body-side hook 1141 and the open/close-lid-side hook 21 are disengaged, and the open/close lid 2 is opened because of the biasing member 3 described later.

(Open/Close-Lid-Side Sealing Loop)

As shown in FIG. 1, the open/close-lid-side sealing loop 22 is a loop-shaped projection protruding in the lower direction, and formed in the middle of the lower surface of the open/close lid 2 in the closing state. As shown in FIG. 3 and FIG. 4, the inner periphery of the open/close-lid-side sealing loop 22 is formed so as to be fit to the outer periphery of the body-side sealing loop 113 formed on the upper container body 11.

(Material of Open/Close Lid)

As shown in FIG. 1, in the open/close lid 2, the open/close-lid-side sealing loop 22 and a portion surrounded by the open/close-lid-side sealing loop 22 are formed of a similar elastic material as used in the upper container body 11 etc., and the other portions are formed of, for example, polyethylene, polypropylene, and the like.

They are integrally formed by injection molding (double molding).

{Biasing Member}

The biasing member 3 biases the open/close lid 2 in the opening direction such that, when a user pushes the latch 114 and disengages the body-side hook 1141 and the open/close-lid-side hook 21, the open/close lid 2 is opened by pivoting on the connecting portion between the open/close lid 2 and the rear upper container body 11 as a pivot shaft.

As shown in FIG. 1 to FIG. 4, the biasing member 3 is a portion of an elastic material provided on the upper container body 11 and the open/close lid 2 so that the rear portion of the body-side sealing loop 113 of the upper container body 11 is connected to the rear portion of the open/close-lid-side sealing loop 22 of the open/close lid 2 in the closing state. That is, the biasing member 3 is formed integrally with and embedded in the upper container body 11 and the open/close lid 2, such that the portion formed of the elastic material in the upper container body 11 and the portion formed of the elastic material in the open/close lid 2 are connected to each other.

The biasing member 3 is formed of an elastic material such as silicone rubber and thermoplastic elastomer such as styrene-butadiene type, polyester type, polyethylene type and urethane type, that is similar to the one used in the portion surrounded by the body-side sealing loop 113 of the upper container body 11 and the like.

The biasing member 3 is formed on the upper container body 11 and the open/close lid 2 in a band shape having a width of preferably 2 mm to 30 mm, more preferably 8 mm to 10 mm, and a thickness of preferably 0.5 mm to 3 mm, more preferably 1 mm to 2 mm.

When the biasing member 3 is shaped to have such dimensions, it is possible to push up the open/close lid 2 without difficulty and to fold the biasing member 3 easily in the recessed portion 111 when the open/close lid 2 is in the closing state.

As shown in FIG. 3, the biasing member 3 is folded at the base of the open/close lid 2 when the open/close lid 2 is closed. When a user pushes the latch 114 and disengages the body-side hook 1141 and the open/close-lid-side hook 21, the open/close lid 2 is opened to be in a state shown in FIG. 2 by the stretching force of the folded biasing member 3.

When a user pushes the open/close lid from the upper side, the biasing member 3 is folded, and the open/close lid 2 is closed to be in a state shown in FIG. 3.

Effect from Embodiment

According to the container for housing household tissue paper 100 according to the embodiment, when a user operates the latch 114 and disengages the opening/close lid 2, the open/close lid 2 jumps up automatically because of the biasing member 3. Therefore, it is easy to open the open/close lid when using the household tissue paper.

Furthermore, the biasing member 3 is formed of the same elastic material as the other portion(s) formed of an elastic member in the upper container body 11 and the open/close lid 2, such as the periphery of the outlet 112, and can be formed integrally with the container body 1 and the open/close lid 2. Therefore, because it is not necessary to use different materials or to increase the number of parts, the biasing member 3 does not result in less productivity.

In particular, the periphery of the outlet 112 of the upper container body 11 is preferably formed of an elastic material in order to apply moderate resistance to the household tissue paper P. According to the present embodiment, the biasing member 3 can be formed continuously from the periphery of the outlet 112. Such an embodiment is further preferred in terms of productivity because it is not necessary to prepare the biasing member 3 as an elastic material separate from the periphery of the outlet 112.

Furthermore, the body-side sealing loop 113 in the upper container body 11 and the open/close-lid-side sealing loop 22 in the open/close lid 2 are each formed of an elastic material so as to fit to each other when the open/close lid 2 is closed. As a result, the airtightness of the outlet 112, and eventually the housing space S inside the container body 1, can be improved. This effect can be particularly enhanced when both the body-side sealing loop 113 and the open/close-lid-side sealing loop 22 are made of an elastic material.

Because the upper nonslip portion 115 formed at the rear portion of open/close lid 2 on the upper surface of the container body 1 is made of an elastic material, the open/close lid 2 is more stable when it is open.

The container body 1 is constituted by the upper container body 11 and the lower container body 12 that are connected to each other at the rear surface, accordingly, the container body 1 can be opened at its middle portion, and the household tissue paper P stored in the interior housing space S can be refilled.

Therefore, it is possible to refill the household tissue paper P while the container for housing household tissue paper 100 is not lifted from but left on the table or the like.

The upper container body 11 and the lower container body 12 are connected to each other at the rear surface and relatively pivot on the connecting portion as a pivot point. In this way, the housing space S can be opened and closed. Therefore, after refilling and the like, the upper container body 11 and the lower container body 12 can easily fit to each other so that the container body is closed without aligning the positions each time. As a result, it is possible to reduce efforts at the time of refilling the inside tissue paper P.

When the container body 1 is closed, the upper fitting portion 116 formed of an elastic material in the upper container body 11 and the lower fitting portion 121 formed of an elastic material in the lower container body 12 fit to each other, and the airtightness of the container body 1 can be improved. This effect can be particularly enhanced when both the upper fitting portion 116 and the lower fitting portion 121 are made of an elastic material.

Because the lower nonslip portion 122 made of an elastic material is formed at the lower surface of the container body 1, the container body 1 can be placed more stably on the table or the like.

Furthermore, the container for housing household tissue paper 100 as a whole is made of two kinds of resin materials (an elastic material such as the silicon rubber or thermoplastic elastomer of a styrene-butadiene type, polyester type, polyethylene type, or urethane type, and a relatively hard material such as polyethylene or polypropylene), and can be integrally formed by injection molding (double molding). Therefore, excellent productivity can be also realized from the viewpoints other than the configuration of the biasing member 3 described above.

Modified Embodiment

In the container for housing household tissue paper 100 described in the embodiment, the upper container body 11 and the open/close lid 2 are integrally formed, and the biasing member 3 is also integrally formed with both of them. However, the upper container body 11 and the open/close lid 2 may be formed separately and connected to each other by a hinge and the like.

In this case, the biasing member 3 may be formed integrally only with the upper container body 11, and may be formed separately from the open/close lid 2.

In this case, for example, the biasing member 3 is formed so as to protrude from the upper container body 11, and a gap for fitting to the biasing member 3 is formed in the open/close lid 2. The protrusion of the biasing member 3 is inserted into the gap, and the biasing member 3 is connected to the open/close lid 2.

Also in this case, the biasing member 3 is formed integrally with at least the upper container body 11. Therefore, the productivity can be improved as compared with the case where the biasing member 3 is formed separately from the upper container body 11 and separately from the open/close lid 2.

The biasing member 3 is not limited to be arranged as shown in the drawings. It is arranged only in one middle position in FIG. 1, but may be arranged at a plurality of positions in the left-right direction, for example.

The biasing member 3 is not limited to be formed integrally with and embedded in the upper surface of the upper container body 11 and the open/close lid 2 as shown in FIG. 1.

Figure 5:
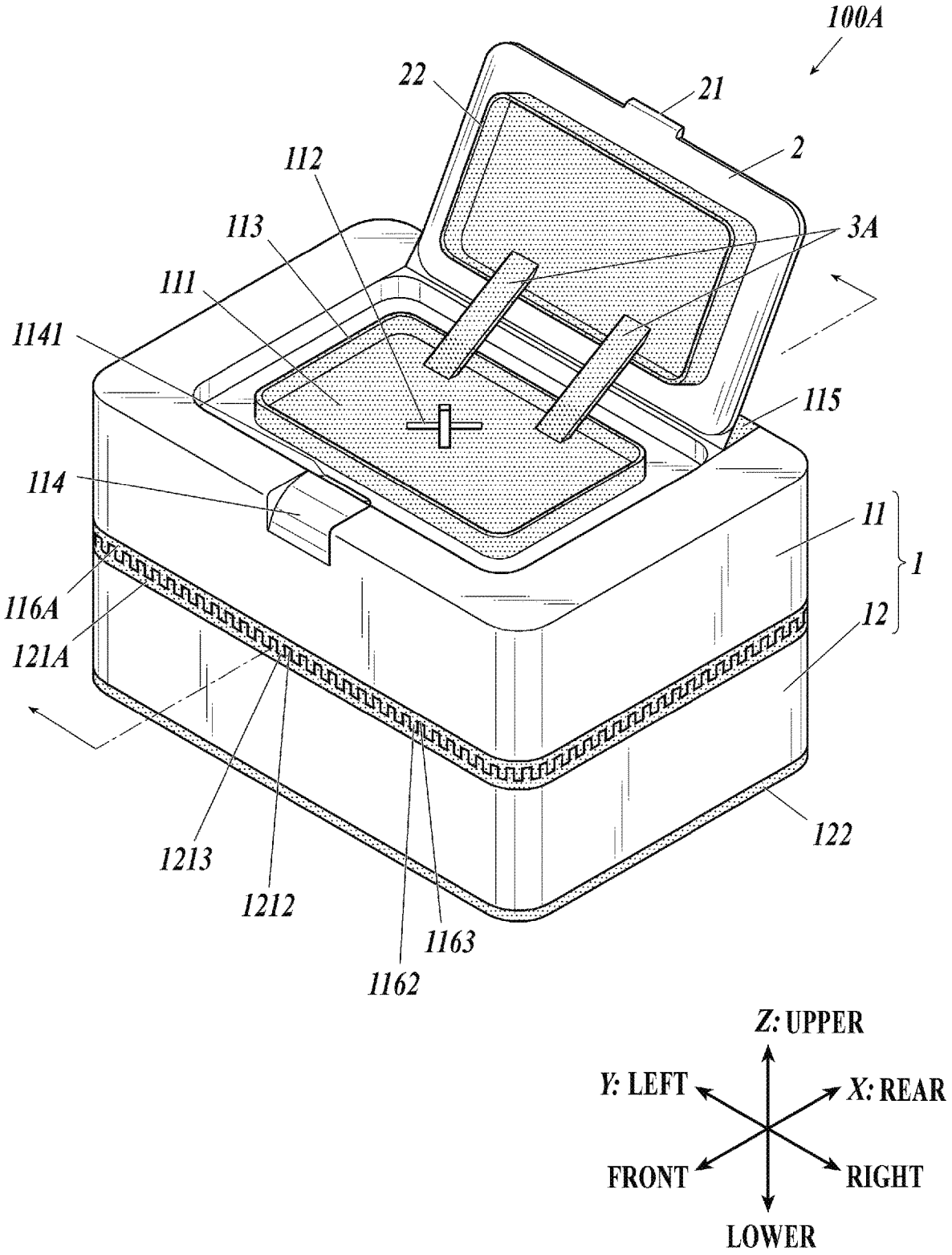
FIG. 5 is a perspective view of a container for housing household tissue paper according to a modified embodiment. Shaded areas represent portions formed of an elastic material.
Figure 6:
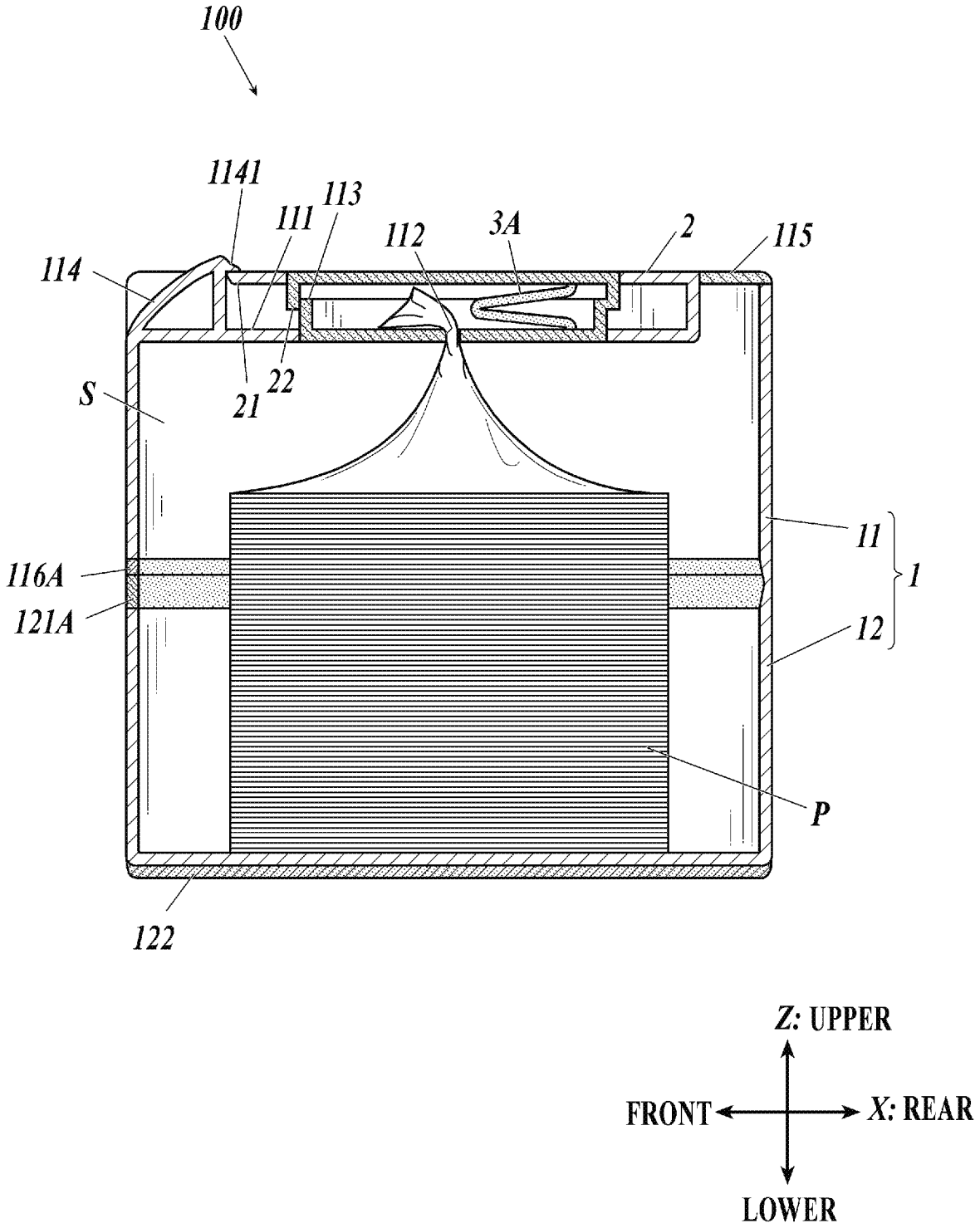
FIG. 6 is a sectional view of FIG. 5 cut through a middle portion in Y direction when an open/close lid is in a closing state. Shaded areas represent portions formed of an elastic material.

For example, as shown in FIG. 5 and FIG. 6, only one end of a biasing member (s) 3A may be connected to the portion formed with the elastic member on the upper surface of the upper container body 11 and only another end of the biasing member is connected to the portion formed with the elastic member of the open/close lid 2, such that the biasing member 3A is formed integrally with and bridges the upper container body 11 and the open/close lid 2. Alternatively, the biasing member 3 may be integrally formed only with the upper container body 11, and may be connected to the open/close lid 2 by a method using a recessed portion for fitting, using a hinge, and the like. As shown in FIG. 6, when the open/close lid 2 is closed, the biasing member 3A is folded with the fold at the front. When a user pushes the latch 114 to disengage the body-side hook 1141 and the open/close-lid-side hook 21, the open/close lid 2 is opened to be in a state shown in FIG. 5 by the stretching force of the folded biasing member 3A.

When a user pushes the open/close lid from the upper side, the biasing member 3A is folded naturally, and the open/close lid 2 is closed to be in a state shown in FIG. 6.

Such a biasing member 3A has a complicated structure as compared with the biasing member 3 according to the above embodiment, but can exert a large biasing force.

The biasing member(s) 3A is also not limited to be arranged as shown in the drawings.

There are two biasing members 3A in FIG. 5, but may be only one biasing member in the middle, or may be three or more biasing members.

The biasing member 3A is connected to the inside of the body-side sealing loop 113 and the inside of the open/close-lid-side sealing loop 22 in FIG. 5 and FIG. 6, however, the biasing member 3A may be connected to the outside of the body-side sealing loop 113 and the outside of the open/close-lid-side sealing loop 22, that is, to portions each formed of an elastic material and extending to stick outward.

The upper fitting portion 116 of the upper container body 11 and the lower fitting portion 121 of the lower container body 12 are not limited to those shown in FIG. 1 to FIG. 4. For example, as shown in FIG. 5, the upper container body 11 may have an upper fitting portion 116A having upper projections 1162 and upper recessed portions 1163 at regular intervals, and the lower container body 12 may have a lower fitting portion 121A having lower projections 1212 and lower recessed portions 1213 at regular intervals. The projections and recessed portions fit to each other when the container body 1 is closed, and the upper fitting portion 116A and the lower fitting portion 121A fit to each other.

Because such an upper fitting portion and lower fitting portion can firmly fit to each other, the upper container body and the lower container body are unlikely to come off during usage of the container for housing household tissue paper. Furthermore, the open/close lid 2 of the upper container body is not limited to have the structure in the drawings where the biasing means 3 biases the open/close lid 2, but may have any structure as long as it can open and close the outlet 112. For example, an open/close lid 2 may not have a biasing means but formed so as to be held by a user to be opened and closed by hand every time.

The present invention is suitably applied in a technical field of manufacturing a container for housing household tissue paper.

The invention claimed is:

1. A container for housing household tissue paper, the container comprising:

a container body configured to store the household tissue paper therein, wherein:

the container body includes an upper container body that forms an upper portion of the container body and a lower container body that forms a lower portion of the container body, the upper container body has an outlet through which the household tissue paper is taken out from the container body and an open/close lid that is configured to close to seal the outlet and to open with respect to the outlet, a lower end of the upper container body and an upper end of the lower container body are connected to each other, the upper container body and the lower container body are pivotable with respect to each other, the upper container body has an upper fitting portion formed of an elastic material at a lower end of the upper container body, the upper fitting portion being formed around the upper container body except for a portion of the upper container body connected to the lower container body, and the lower container body has a lower fitting portion formed of an elastic material at an upper end of the lower container body, the lower fitting portion being configured to fit to the upper fitting portion and being formed around the lower container body except for a portion of the lower container body connected to the upper container body, wherein the upper fitting portion has upper projections and upper recessed portions that are formed alternately in a peripheral direction of the upper fitting portion, the lower fitting portion has lower projections and lower recessed portions that are formed alternately in a peripheral direction of the lower fitting portion, and when the upper fitting portion and the lower fitting portion fit to each other, the upper recessed portions and the lower projections fit to each other and the upper projections and the lower recessed portions fit to each other.

2. The container according to claim 1, wherein:

the container body has a substantially rectangular parallelepiped shape, and the upper container body and the lower container body are connected to each other only at one side of the container body.

3. The container according to claim 1, wherein the container body is divided into the upper container body and the lower container body above a middle position of the container body in an upper-lower direction.

4. The container according to claim 1, wherein:

the upper fitting portion has an upper protrusion that protrudes in a lower direction, the upper protrusion being provided only at an outer circumferential side or an inner circumferential side of the upper fitting portion, the lower fitting portion has a lower protrusion that protrudes in an upper direction, the lower protrusion being provided only at an inner circumferential side or an outer circumferential side of the lower fitting portion, and the upper protrusion and the lower protrusion are configured to fit to each other.

5. The container according to claim 1, wherein the lower container body has a nonslip portion formed of an elastic material at a lower surface of the lower container body.

6. The container according to claim 1, wherein a hardness of the elastic material is in a range of 20 to 90, measured in accordance with JIS K 6253 (type A durometer).

7. The container according to claim 1, wherein the upper container body has an upper nonslip portion formed of an elastic material on an upper surface of the upper container body at a side opposite from the outlet with respect to a portion of the upper container body that connects to the open/close lid.

8. The container according to claim 1, further comprising:

a biasing member that is formed of an elastic material integrally with the upper container body and biases the open/close lid in an opening direction.

* * * * *